United States Patent [19]

Hesch et al.

[11] Patent Number: 4,626,154

[45] Date of Patent: Dec. 2, 1986

[54] TRAILER HITCH WITH ELASTOMER IN SHEAR CUSHIONING

[75] Inventors: Harold E. Hesch, St. John, Ind.; Michael W. Diluigi, Burnham, Ill.

[73] Assignee: Pullman Standard Inc., Chicago, Ill.

[21] Appl. No.: 467,966

[22] Filed: Feb. 18, 1983

[51] Int. Cl.[4] ..... B60P 3/07

[52] U.S. Cl. ..... 410/56; 267/70; 410/63

[58] Field of Search ..... 410/60, 61, 62, 63, 410/56; 267/63 A, 153, 141.1, 70, 73; 248/632, 634

[56] References Cited

U.S. PATENT DOCUMENTS

| | | | |
|---|---|---|---|
| 2,165,375 | 7/1939 | Heitner | 267/63 A |
| 3,358,955 | 12/1967 | Wille et al. | 410/64 |
| 4,074,633 | 2/1978 | Hicks, Jr. et al. | 410/63 |
| 4,339,996 | 7/1982 | Brodeur et al. | 410/63 X |

FOREIGN PATENT DOCUMENTS

| | | | |
|---|---|---|---|
| 535259 | 4/1941 | United Kingdom | 267/63 |
| 732177 | 6/1955 | United Kingdom | 280/45 |

*Primary Examiner*—Robert B. Reeves
*Assistant Examiner*—Glenn B. Foster
*Attorney, Agent, or Firm*—Richard J. Myers & Assoc.

[57] ABSTRACT

A trailer hitch for securing trailers to a platform or deck of a railway flat car comprises an upright pedestal pivotally connected so that it and a fifth wheel plate can be attached to the kingpin of a trailer. The hitch includes a diagonal assembly pivotally connected to the pedestal and being rockable therewith. The diagonal assembly comprises diagonally extending outer thrust members and a central thrust member. A pair of laterally spaced upright support plates are rigidly connectd to the platform or deck. The outer thrust members support in spaced relation a plurality of resilient members on their inner surfaces. The resilient members are also connected to the support plates. Other similar resilient members are connected to the inner surfaces of the upright support plates and these are also connected to the central thrust member thereby providing a completely cushioned trailer hitch.

10 Claims, 9 Drawing Figures

45
46
47
48
49
50
51
52
53
54
60
61
35
8
9

TRAILER HITCH WITH ELASTOMER IN SHEAR CUSHIONING

BACKGROUND OF THE INVENTION

1. Field of Invention

This invention relates to trailer hitches of the type used to retain over the highway trailers on the platform of railway cars, ship decks and the like. More specifically the trailer hitch includes in its diagonal leg improved elastomeric cushioning means.

2. Description of the Prior Art

The prior art is best exemplified in the Wille U.S. Pat. No. 3,358,955 which discloses cushioning for the diagonal leg of a trailer hitch wherein the cushion uses a plurality of rubber pads placed in shear with the structure disposed on the deck of a railway car. The Hicks U.S. Pat. No. 4,074,633 utilizes an elastomer in shear cushion arrangement wherein the resilient pads are suitably connected to the diagonal member of the trailer hitch and extend substantially the length thereof. This type of cushioning is effective, less expensive and has high durability. The present invention is concerned with the use of elastomer cushions wherein a plurality of individual relatively small cushions are provided in a more effective cushioning arrangement.

SUMMARY OF THE INVENTION

The invention is concerned with a trailer hitch for securing trailers to stationery platforms, ship decks, or railway flat cars. In most of the prior art trailer hitches elastomeric units are placed in line to provide in shear cushioning of the diagonal support. In the present invention the rubber pads or elastomeric cushioning members are arranged in a side by side configuration. One embodiment of the invention includes a diagonal cushioning frame which comprises a pair of relatively wide thrust member plates with a central anchoring thrust plate disposed between the wide plates with a total of eight cushioning pads connected between the central member and the thrust plates. The anchoring central thrust member is guided by upper and lower guide straps connected between and to the outer thrust member plates. This arrangement permits the utilization of a relatively short diagonal leg and assures adequate cushioning under all conditions.

Another embodiment of the invention utilizes a diagonal frame arrangement wherein a pair of upright anchoring plates are connected to a platform. The diagonal frame comprises spaced thrust elements which are pivotly supported on a transverse pivot member of the vertical frame members of the hitch. A total of eight elastomer cushioning pads are secured between the anchoring plates and the thrust elements to provide cushioning wherein a relatively short diagonal frame design is achieved.

DESCRIPTION OF THE PREFERRED EMBODIMENT

Figure 1:
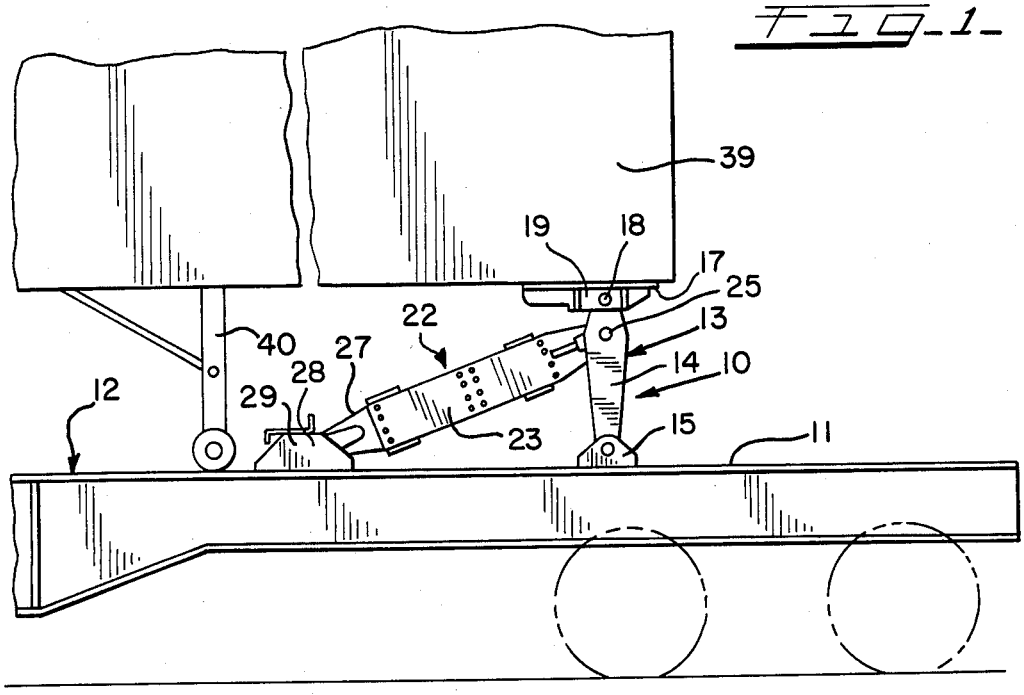
FIG. 1 is a side elevational view of a trailer hitch mounted on the deck of a railway flat car.
Figure 5:
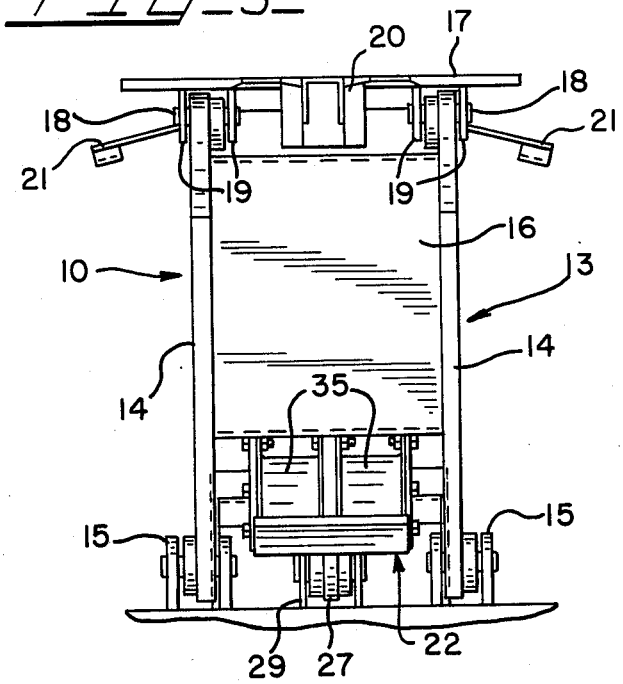
FIG. 5 is an end elevational view taken along the line 5—5 of FIG. 3.

Referring now to FIG. 1 through 5, a trailer hitch 10 is supported on the deck 11 of a railway flat car 12.

A trailer hitch upright frame 13 includes upright legs 14 supported on the deck 11 by means of pivot brackets 15. A vertical connector plate 16 is suitably connected to the legs 14. A fifth wheel plate 17 is connected to the legs 14 by transverse pivot pins 18 journalled in brackets 19. The fifth wheel plate includes a gathering slot 20 and locking members 21 of conventional design in the art.

Figure 2:
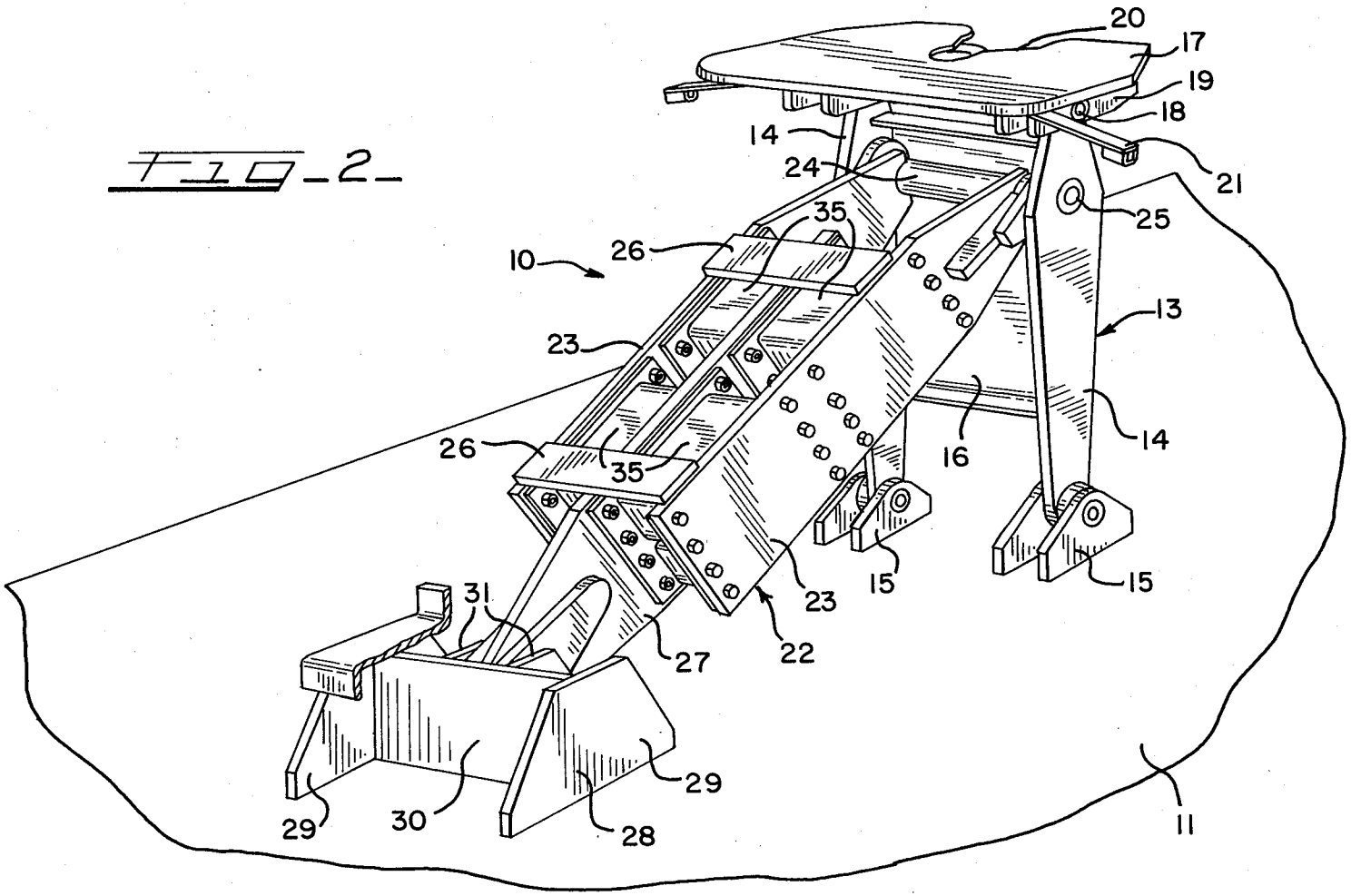
FIG. 2 is a perspective view of the trailer hitch disclosed in FIG. 1.
Figure 4:
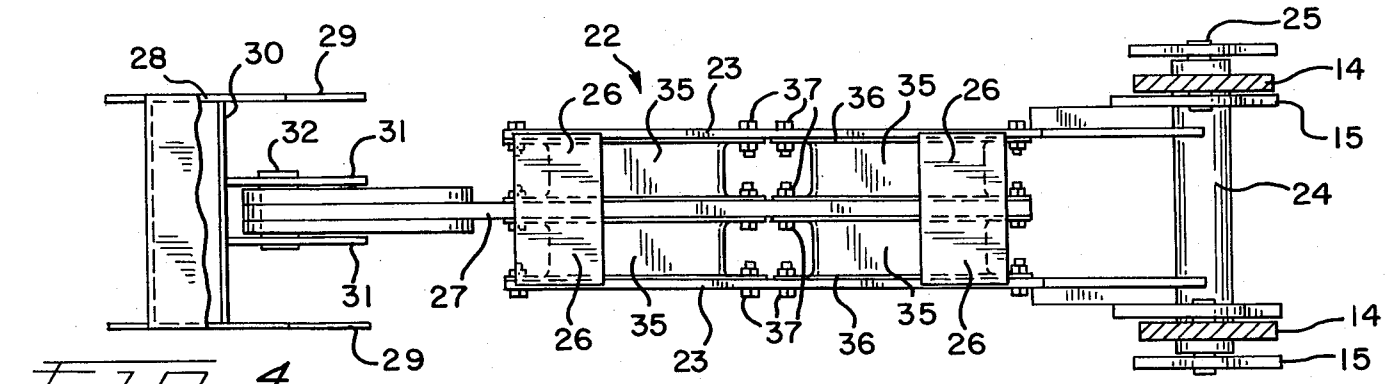
FIG. 4 is a partial cross sectional view taken along the line 4—4 of FIG. 3.
Figure 3:
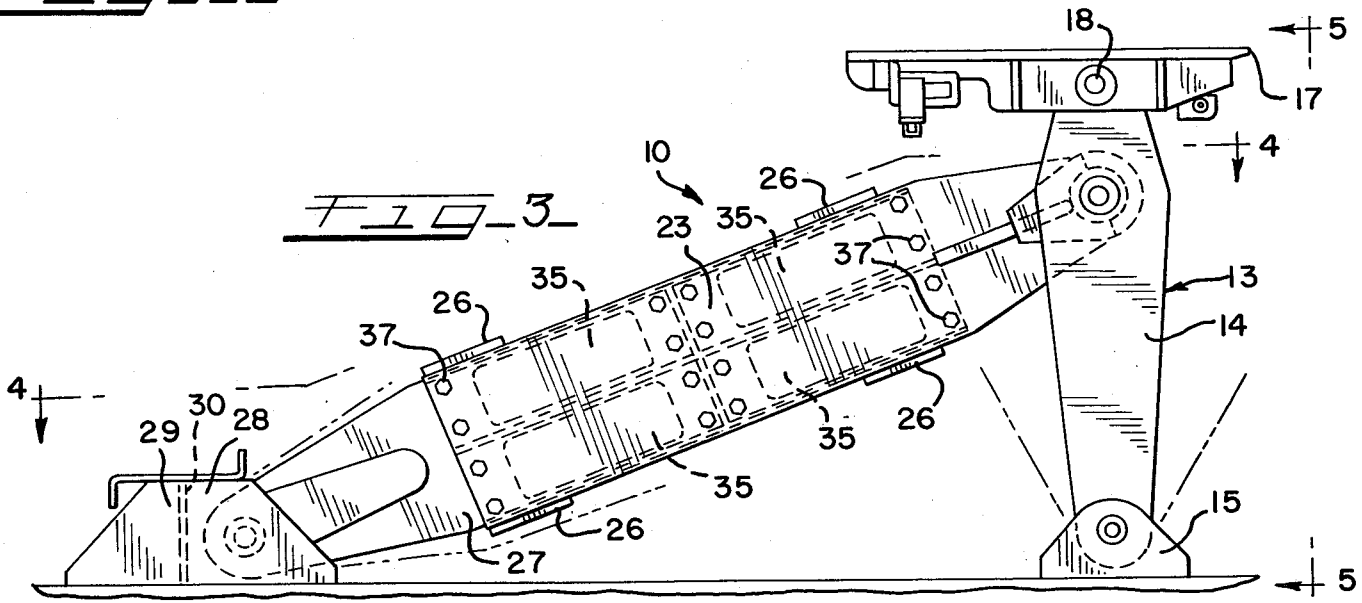
FIG. 3 is an enlarged side elevational view of the hitch.
Figure 6:
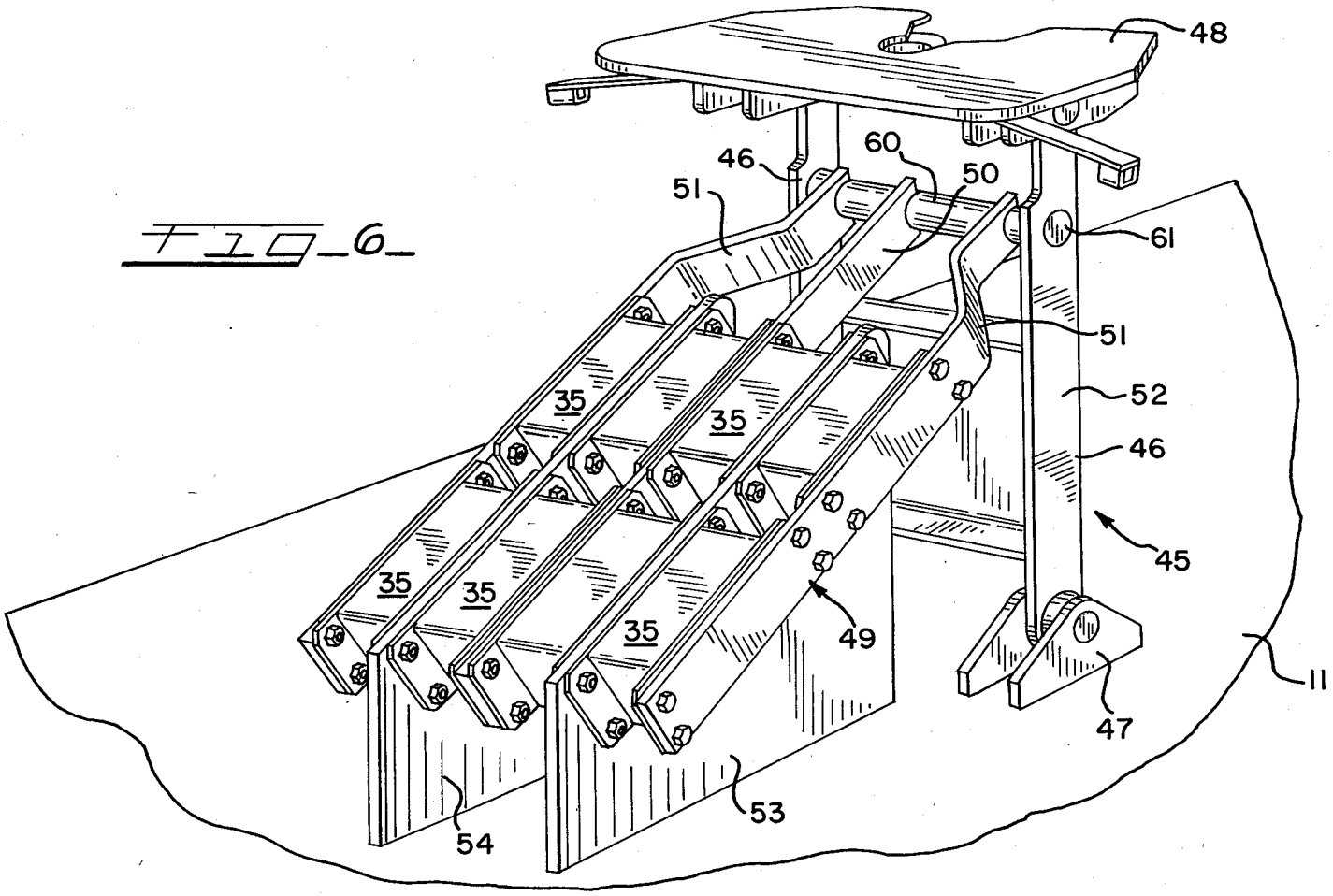
FIG. 6 is a perspective view of another embodiment of the trailer hitch invention.
Figures 7, 8, 9:
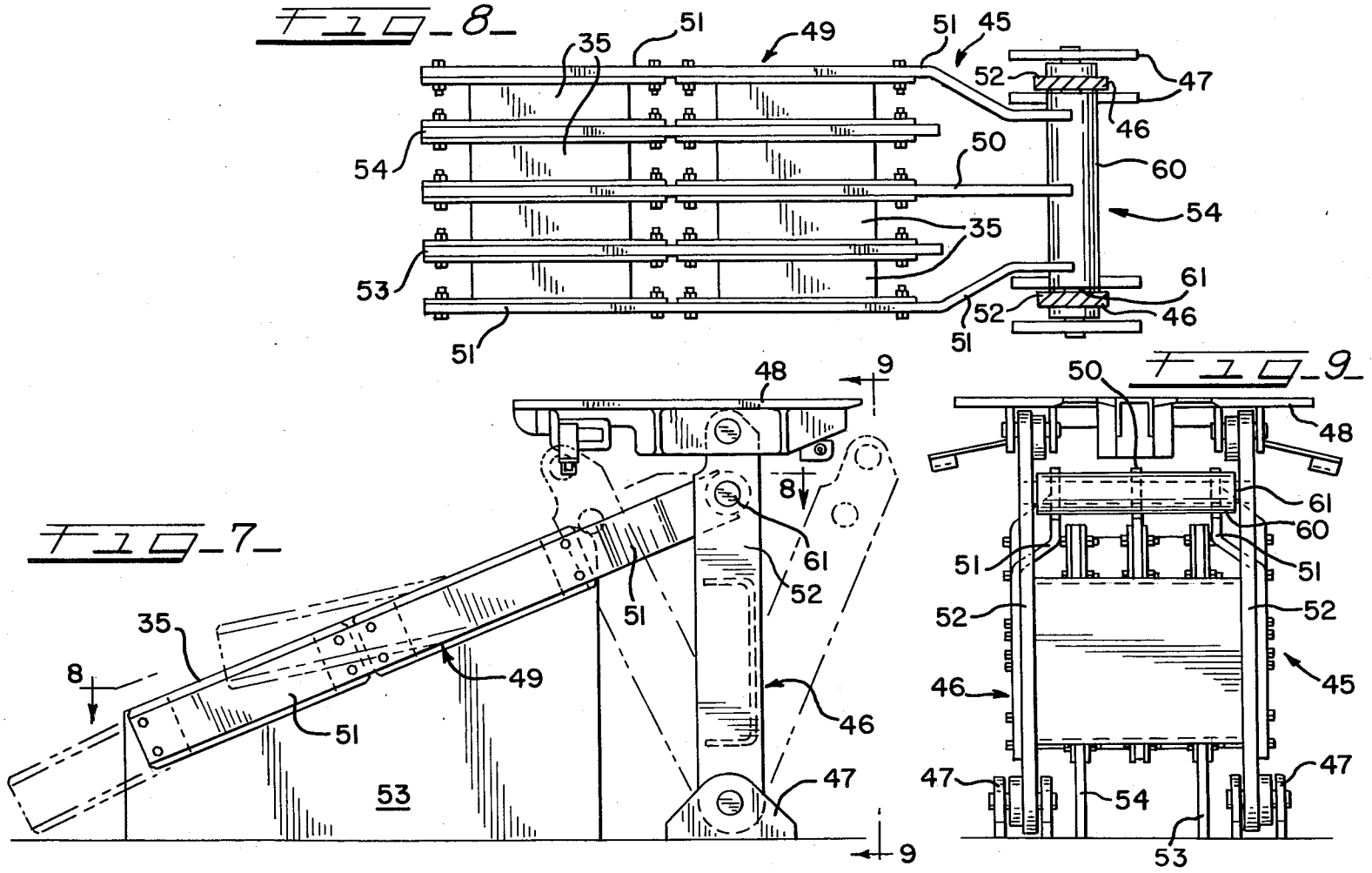
FIG. 7 is a side elevational view of the trailer hitch of FIG. 6.
FIG. 8 is a cross sectional view along the line 8—8 of FIG. 7.
FIG. 9 is an end elevational view taken along the line 9—9 of FIG. 7.

A diagonal leg assembly 22 includes a pair of thrust plate members 23 connected together at their upper ends by means of a transverse pivot sleeve 24 rotatably mounted on a transverse pivot pin 25 secured to the upper ends of the legs 14. As best shown in FIG. 2, the thrust plates 23 are interconnected by upper and lower guide brackets 26. A slideable anchoring thrust member 27 is connected to a bracket 28 securely fastened to the deck. The bracket 28 comprises vertical plate members 29, a transverse plate 30 and pivot brackets 31 which by a pivot pin 32 pivotally supports the end of the anchoring thrust member 27. As best shown in FIGS. 2 and 4 individual elastomeric cushions 35 are suitably connected to the anchoring member or thrust plate 27 and to the outer thrust plate members 23. The elastomeric cushions 35 are of rectangular shape and are suitably bonded to parallel plates 36 which project outwardly from the ends of the cushions and the plates are connected by bolt fastener 37 to the thrust members 23 and anchoring member 27. As best shown in FIGS. 3 and 4 the cushions total eight in the arrangement, this number and size of cushion having excellent cushioning ability while still permitting the most desireable objective which is the effective shortening of the diagonal cushioning member. The eight cushions are distributed as two sets of four cushions, one set being on each side of the anchoring member 27. Each set of four cushions is arranged in two rows of cushions lengthwise and two rows of cushions transversely with respect to the diagonal leg assembly 22. The in-line disadvantages of the prior art cushions are thus eliminated and the grouping of the cushion in the manner indicated i.e. side-by-side, permits this shortening of the diagonal. A more positive and effective cushioning is achieved with less space requirements and a decrease in the weight of the assembly. FIG. 1 also discloses a highway trailer 39 supported on the trailer hitch 10 and a trailer landing gear 40.

FIGS. 6, 7, 8, and 9, show a modified embodiment of the invention. The hitch 45 includes uprights 46 pivoted on brackets 47 connected to the deck 11. The top plate 48 is similar to the embodiment of FIGS. 1 & 2 and need not be further described. The primary difference in this modified invention is in the diagonal frame 49. The frame 49 comprises a central thrust bar 50 and outer thrust bars 51 which are pivotally supported at their upper ends of the legs 52. A pivot tube 60 is pivotally connected to the upper portions of the legs 52, by a pivot bar 61.

A pair of vertical anchoring plates 53 and 54 are secured to the deck 11. This connection may be made by suitable fasteners or welds not shown. The frame 49 utilizes the same type of elastomer cushions 35 as described in the preferred embodiment. Four cushions 35 are connected to the central thrust bar by the bolt and nut arrangement indicated. The four are also connected to inner sides of the anchoring plates 53 and 54. The other four cushions are connected to the outer surfaces of the anchoring plates 53 and 54 and also to the outer thrust members 51 to provide the unique arrangement of cushions which permit the reduction in the length of the diagonal frame thus achieving a much shorter total frame length and more effective cushioning assembly than the in-line arrangements of the prior art. Another effective advantage of the present invention is the quick replacement of a worn or defective cushion without requiring the discardation of an entire assembly.

The foregoing disclosure of specific embodiments is illustrative of the broad inventive concepts comprehended by the inventor.

What is claimed:

1. A trailer hitch for securing trailers to a platform, said hitch including;

a vertical support member;

a fifth wheel plate supported at the upper portion of said support member, said fifth wheel plate including a kingpin receiving slot;

pivotal means connecting a lower portion of said support member to said platform to permit swinging movement of said vertical support member; and the fifth wheel plate supported thereon, a fixed anchoring bracket on said platform, a diagonal frame member including a pair of laterally spaced first thrust plates, said vertical support member including a pair of spaced upright legs, first pivot means pivotally connecting said upright legs to an upper end portion of said laterally spaced thrust plates, anchoring thrust plate means having opposing sides and being disposed between said first thrust plates, second pivot means pivotally connecting said anchoring thrust plate means to said fixed anchoring bracket, and first and second sets of resilient cushioning elements connected to respective sides of said anchoring thrust plate means and to respective first thrust plates, each of said sets of resilient cushioning elements comprising a plurality of individual separated cushioning elements being positioned in an arrangement having two rows of cushioning element in a lengthwise direction with respect to the diagonal frame member and two rows of cushioning elements in a transverse direction with respect to the diagonal frame member, each of said cushioning elements being connected to the thrust plate means and to the respective thrust plate whereby the diagonal frame member is shorter in length and capable of absorbing substantially the same forces, and whereby the hitch is compact to provide clearance for securing said trailer to said platform.

2. The trailer hitch in accordance with claim 1, said cushioning element being disposed in upper and lower aligned pairs and upper side by side pairs.

3. A trailer hitch in accordance with claim 1 wherein said cushioning elements comprise a total of eight individual cushions.

4. A trailer hitch in accordance with claim 3, said anchoring thrust plate means comprising a single vertical plate projecting downwards from said thrust plates, said anchoring bracket including a transversely extending pivot element extending through and pivotally supporting said thrust plate means.

5. The invention in accordance with claim 1 said thrust plates including upper and lower guide elements carried thereon for supporting said anchoring thrust plate means.

6. The invention according to claim 1 and said thrust plate means and said thrust plates being constrained for cushioning movement with respect to each other in substantially only the lengthwise direction of the diagonal frame member.

7. A trailer hitch for securing trailers to a platform comprising:

a vertical support member including a pair of upright legs pivotally connected to a platform for swinging movement, a fifth wheel plate supported on said upright legs and including a kingpin receiving pocket, diagonal thrust frame means having an upper end pivotally connected with the upright legs, a fixed anchoring bracket on said platform, said anchoring bracket comprising a pair of laterally spaced upright support members fixedly mounted on the platform, each of said upright support members having an upper terminal end, including inward and outward sides, said thrust frame means including a pair of laterally spaced diagonally extending outer thrust members, a first group of individual resilient members connected to the inward sides of the upper terminal ends of said upright support members, a central thrust member disposed between said upright support members, said central thrust member being connected with said upright legs to pivot with said outer thrust members, said first group of resilient members supported inwardly of said upright support members being connected to said central thrust member, and a second group of said resilient members connected to the outward sides of said upright support members and to said outer thrust members;

said resilient members being laterally and longitudinally spaced relative to each other and lying in plane adjacent the upper terminal ends of the upright support members to produce a compact cushioned hitch mounted on the upper surface of the platform and providing clearance for trailer securement on the platform.

8. A trailer hitch in accordance with claim 7, said resilient members lying in the same inclined plane and comprising eight members.

9. A trailer hitch for securing trailers to a platform, the hitch comprising:

a vertical support member;

a fifth wheel plate supported on the upper portion of the support member, the fifth wheel plate including a kingpin receiving slot;

pivotal means connecting a lower portion of the vertical support member to the platform to permit swinging movement of the vertical support member;

first pivot means on the vertical support member, a fixed anchoring bracket on the platform;

second pivot means on the anchoring bracket; and a diagonal frame member being connected with the first and second pivot means, the diagonal frame member including;

a pair of laterally-spaced thrust plates being connected with one of the pivot means;

a thrust plate means being connected with the other of the pivot means and being disposed between the laterally-spaced thrust plates;

said thrust plate means having a pair of opposing sides; and a first set of resilient cushioning elements, being connected to one of the laterally-spaced thrust plates and one of the sides of the thrust plate means and a second set of resilient cushioning elements, being connected to the other of the thrust plates and the other of the sides of the thrust plate means;

each of said sets of resilient cushioning elements comprising a plurality of individual separated cushioning elements positioned in an arrangement having two rows of cushioning elements in a generally lengthwise direction with respect to the diagonal frame member and two rows of cushioning elements in a generally transverse direction with respect to the diagonal frame member, each of the cushioning elements being connected to the thrust plate means and to the respective thrust plate whereby the diagonal frame member is shorter in length and capable of absorbing substantially the same forces and whereby the hitch is compact to provide clearance for securing said trailer to said platform.

10. The invention according to claim 9 and said thrust plate means and said thrust plates being constrained for cushioning movement with respect to each other in substantially only the lengthwise direction of the diagonal frame member.

* * * * *